United States Patent [19]

Anderson et al.

[11] Patent Number: 4,790,084

[45] Date of Patent: Dec. 13, 1988

[54] BACKHOE BUCKET TRANSPORT SYSTEM

[75] Inventors: Ronald L. Anderson, Burlington, Iowa; Donald E. Rieser, Riverside, Ill.

[73] Assignee: J. I. Case Company, Racine, Wis.

[21] Appl. No.: 165,251

[22] Filed: Mar. 7, 1988

[51] Int. Cl.[4] ..... E02F 3/76

[52] U.S. Cl. ..... 37/117.5; 37/DIG. 3; 414/724; 414/912

[58] Field of Search ..... 37/117.5, 103, DIG. 3; 414/722, 723, 724, 912

[56] References Cited

U.S. PATENT DOCUMENTS

| | | | |
|---|---|---|---|
| 2,530,414 | 11/1950 | Wells | 37/117.5 |
| 3,077,999 | 2/1963 | Svobada | 37/117.5 |
| 3,665,622 | 5/1972 | Lamb | 37/117.5 |
| 3,738,030 | 6/1973 | Olinger | 37/117.5 |
| 3,915,501 | 10/1975 | Cobb et al. | 37/117.5 |
| 4,243,356 | 1/1981 | Takojima | 37/117.5 |
| 4,255,884 | 3/1981 | Williams | 37/117.5 |
| 4,328,628 | 5/1982 | Thomas | 414/912 |
| 4,329,103 | 5/1982 | Miller | 414/724 |
| 4,360,980 | 11/1982 | Jarvis | 414/724 |
| 4,669,947 | 6/1987 | Frost | 414/724 |

*Primary Examiner*—Eugene N. Eickholt

*Attorney, Agent, or Firm*—Peter N. Jansson, Ltd.

[57] ABSTRACT

Improved backhoe bucket transport apparatus including an engagement member secured to a loader bucket and having an open hook for engaging and suspending the backhoe bucket by its pivot pin. Normal rolling motion of the loader bucket causes it to receive the backhoe where it may be securely held during transport. Unloading is carried out by reversing the steps.

17 Claims, 3 Drawing Sheets

BACKHOE BUCKET TRANSPORT SYSTEM

FIELD OF THE INVENTION

This invention is related generally to earth-moving equipment and, more particularly, to tractors of the type having a backhoe at one end which uses two or more backhoe buckets from time to time as needed, and a front loader at the other end.

BACKGROUND OF THE INVENTION

Backhoes commonly are designed to use more than one size of bucket. The size of the backhoe bucket selected for a particular task is determined by the requirements of the task. At any given job site, one bucket is frequently unsuitable for the various trenching and excavating tasks which must be performed. Therefore, two or more buckets need to be transported to the job site.

Generally, the extra bucket or buckets have been carried in the front loader bucket of the tractor. In the prior art, loading and unloading of an extra backhoe bucket into the front loader bucket presented a number of problems and difficulties. Either considerable assistance and manipulation were required, or the ground supporting the extra bucket, prior to its loading into the loader bucket, was frequently dug up or damaged.

More specifically, if loading of an extra backhoe bucket into the loader bucket of a tractor was to be accomplished by an operator at the controls of the tractor, the operator would have to scoop the backhoe bucket off the ground with the front loader bucket. This operation, because of the size, weight, and weight distribution of the backhoe bucket, necessitated scooping under the backhoe bucket in a manner disturbing the ground beneath it. Portions of the surface, whatever it might be, were scooped into the loader bucket along with the backhoe bucket. Indeed, because of the size and weight of the bucket, multiple attempts could often seriously disturb the ground material.

Not only was the surface disturbed, but the surface material was removed and transferred with the extra backhoe bucket to the new job site, where it was unloaded along with the extra backhoe bucket. And, the unloading operation, like the loading operation, often caused ground disturbance, particularly if carried out by a single operator.

These problems become particularly acute when excavation work is being carried out in areas other than completely new construction sites. Clearly there is a need for an improved system of transport for extra backhoe buckets.

OBJECTS OF THE INVENTION

It is an object of this invention to provide an improved backhoe bucket transport system overcoming certain problems and shortcomings of the prior art, including those mentioned above.

Another object of this invention is to provide an improved backhoe bucket transport system eliminating disturbance of the ground, and related problems, during backhoe bucket loading and unloading.

Another object of this invention is to provide apparatus for loading extra backhoe buckets into the front loader bucket without unintentionally picking up and transporting portions of the surface material and then unintentionally unloading such material when the extra backhoe bucket is unloaded.

Another object of this invention is to provide apparatus for backhoe bucket transport which may be operated easily by one person from the tractor seat, yet without the above problems.

Another object of the invention is to provide an extra bucket transport attachment which is simple in construction.

Another object of the invention is to provide a backhoe bucket transport attachment which is out of the way of all typical loader bucket operations.

These and other important objects will be apparent from the following description of this invention.

SUMMARY OF THE INVENTION

This invention is an improved backhoe bucket transport system of the type with a tractor, a front loader bucket attached to the tractor, and a backhoe bucket in the loader bucket. The transport system of this invention overcomes certain problems and shortcomings of the prior art, including those described above.

The invention includes an apparatus attached to the front loader bucket, usually the front loader bucket of a tractor of the type also including a backhoe which uses one of two or more backhoe buckets as needed. The invention involves transporting the extra backhoe bucket or buckets in the loader bucket in a manner which allows easy, damage-free loading and unloading.

A front loader bucket, of course, has top and bottom walls which terminate in top and bottom edges along the open side of the loader bucket. The invention includes an engagement member secured to the loader bucket and having an open hook configured to receive the mounting pin of a backhoe bucket. The engagement member is positioned such that its hook is adjacent to the top edge to support the backhoe bucket within the loader bucket during carrying.

The positioning and support is such that pivoting of the loader bucket on the hook, about the backhoe-bucket mounting pin, allows rotation of the backhoe bucket with respect to the loader bucket. Thus, by pivoting the loader bucket and a little lifting of the loader bucket, using loader-bucket controls in the normal manner, the extra backhoe bucket can be first engaged on the hook and then gradually swung into the loader bucket in a sort of nested fashion. Unloading can be accomplished using the reverse of the loading operations.

The loading and unloading operations are all carried out by the tractor operator from the operator's seat. And, with the simple lifting-pivoting action of this invention, as opposed to a scooping action, an extra backhoe bucket may be transported in the front loader bucket to a job site and unloaded there, without digging into the surface material and the transport of portions of the surface material on which the extra backhoe bucket rested before loading.

The engagement member, which includes the aforementioned hook, is preferably movably secured to the bucket in a manner such that the hook is movable between a first position which is inside the top edge and a second position which is outside the top edge. In such second position, the end of the hook is preferably above the ground when the loader bucket has its open side on the ground, as is often the case, particularly when the loader bucket is being used as an anchor during backhoe operations. In such position, with both the top edge and the bottom edge of the loader bucket on the ground, the end of the hook does not reach the ground. Thus, it will not interfere with normal bucket operations.

The engagement member and hook will move so that the hook is in the second position by the operation of biasing means, preferably a spring, such as a coil spring. In one preferred arrangement, first and second spring-attachment members are affixed to the engagement member and bucket, respectively, and the spring extends in tension between them.

The engagement member preferably is an elongated member with a proximal end, a distal end, and a top-wall spanning portion extending between the proximal and distal ends. The engagement member also has pivot-mounting means near the proximal end for pivoting attachment of the engagement member to the loader-bucket top wall. At the distal end, a hook portion extends transverse to the top-wall spanning portion so that, when such top-wall spanning portion engages the top wall, the hook portion extends across the top edge of the loader bucket and the hook is in the first position.

The hook portion preferably includes a U-shaped slot extending toward the aforementioned proximal end. Such U-shaped slot is dimensioned to receive the backhoe-mounting pin, such that the backhoe bucket can be held securely by the engagement member in the loader bucket.

The pivot mounting of the engagement member to the top wall of the loader bucket is preferably done in a specific manner. The loader bucket, of course, includes a mounting ear (usually a pair of mounting ears) on its top wall with a loader-mounting pin extending through such ear for pivot mounting. The preferred manner of mounting the engagement member is to engage it pivotably about such loader-mounting pin.

Referring now more specifically to a preferred biasing arrangement, the second spring-attachment means is affixed to the bucket top wall between the pivot-mounting means and the loader-bucket top edge, and the pivot-mounting means on the engagement member is between the first spring-attachment member and the hook portion. In such arrangement, the engagement member functions as a first-degree lever.

The engagement member itself is preferably a weldment made of a very limited number of parts. These include a pair of the aforementioned elongated members and a plate or other connecting piece between them holding them together in parallel spaced relationship. The proximal ends of the elongated members have openings in them for pivotable engagement with the loader-bucket pin. Bushings are preferably welded on the proximal ends, about the pivot openings.

With such preferred engagement member structure, a pair of springs is preferably used to bias the engagement member and its hooks to the second position, which is out of the way of loader-bucket operations. The tension of the springs is sufficient to keep the hook attachment up and out of the way. But weight of the extra backhoe bucket is more than enough to allow the spring tension to be overcome during loading of the backhoe bucket into the loader bucket.

The loading operation is now described in detail: With the operator in the tractor seat, using the loader bucket controls, the loader bucket is rolled forward toward its open side down orientation, thereby pivoting the hook attachment outwardly. At this point, the hook is still in its second position, under the biasing effect of the spring or springs. The tractor is driven forward so that the hook or hooks of the engagement member pass under the extra backhoe-bucket mounting pin.

Then, the engagement member is raised, by the raising and/or backward (upward) rolling of the loader bucket, and the hook(s) engage the backhoe-bucket mounting pin and raise it from the ground. When the extra backhoe bucket is raised from its resting surface, the loader bucket is rolled backward and upward. As this occurs, the extra backhoe bucket pivots with respect to the loader bucket until it rotates right into the front loader bucket. The weight of the extra backhoe bucket prevents the springs from pulling the hook attachment to its out of the way position. Since the extra backhoe bucket is off the ground as the loader and backhoe buckets roll together, no portion of the surface upon which the extra backhoe bucket was resting is disturbed or scooped into the loader bucket.

The aforementioned slot serves to secure the extra backhoe bucket in the front loader during transport.

The extra backhoe bucket may be unloaded from the loader bucket using the loader bucket controls. As the loader bucket rolls forwardly, the extra backhoe bucket pivots outwardly with respect to the loader bucket, with the backhoe-bucket pivot pin and hook(s) in pivoting engagement. More accurately, the loader bucket pivots about the backhoe bucket, which hangs more or less in a fixed orientation. As this occurs, the backhoe bucket comes out of the loader bucket. The loader bucket is then lowered until the extra backhoe bucket touches the ground and the hook(s) of the engagement member disengages from the backhoe bucket mounting pin.

This unloading method eliminates any dumping or other uncontrolled action. No ground disturbance occurs during the unloading operation.

DETAILED DESCRIPTIONS OF PREFERRED EMBODIMENTS

Figure 1:
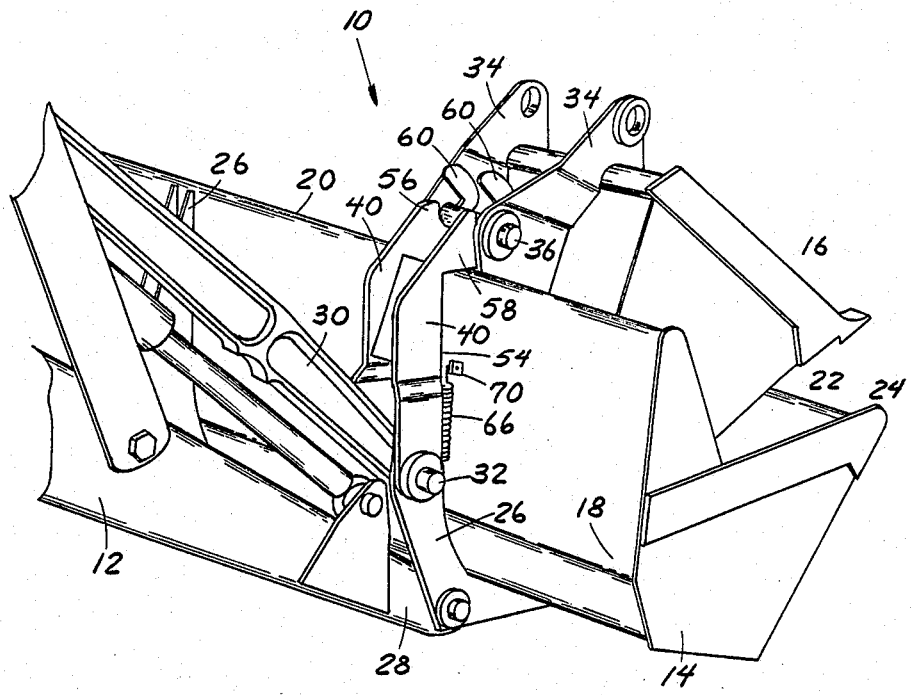
FIG. 1 is a perspective view of a preferred backhoe bucket transport apparatus in accordance with this invention.

The figures illustrate an improved backhoe bucket transport apparatus 10 of the type including a tractor 12, a front loader bucket 14 attached to the tractor, and a backhoe bucket 16 carried in loader bucket 14.

Front loader bucket 14 has a top wall 18 which terminates in top edge 20 and a bottom wall 22 which terminates in a bottom edge 24. Loader bucket 16 also includes ears 26 by which it is attached to tractor 12. More specifically, loader bucket ears 26 are used for attachment to a loader frame 28 and a loader bucket link arm 30 of tractor 12. Link arm 30 is secured to ears 26 by means of a loader bucket mounting pin 32. There are a pair of link arms 30 and two parts of loader frame 28 engaged to two different ear sets 26 along wide loader bucket 14. Loader bucket 14 may be lifted by loader frame 28 and rolled or pivoted in the normal manner by virtue of the movement of link arms 30.

Backhoe bucket 16, which in use is mounted to backhoe arms at the opposite end of tractor 12, includes a pair of spaced ears 34 and further includes a backhoe bucket mounting pin 36 which extends between ears 34. Backhoe bucket mounting pin 36 is used in operation of the backhoe bucket transport system of this invention.

Transport apparatus 10 includes, as a principle member, an engagement member 40. The structural details of engagement 40 are shown best in FIG. 2. Engagement member 40 is a five-piece weldment having a pair of mirror-image elongated members 42 which are supported in rigid parallel spaced relationship by means of a center plate 44 welded to each member 42. Each elongated member 42 has a proximal end 46 and a distal end 48. Each proximal end 46 includes an opening 50 and has a bushing 52 which is welded to member 42 about such opening. Openings 50 and bushings 52 are sized to receive loader bucket mounting pin 32 such that engagement member 40 pivots about mounting pin 32.

Each engagement member 40 and, more specifically, each elongated member 42, has a top wall spanning portion 54 between its proximal and distal ends 46 and 48. Each top wall spanning portion 54 engages loader bucket top wall 18 when engagement member 40 is pivoted to a position as close as possible to loader bucket 14.

Each elongated member 42 also has a hook portion 56 at distal end 48. Hook portion 56 has transverse portion 58 which is transverse to top wall spanning portion 54 of elongated member 42. The configuration of each elongated member 42, including its spanning portion 54 and its hook portion 56, is such that hook portion 56 extends across loader bucket top edge 20 when spanning portion 54 is in engagement with loader bucket top wall 18. This position is illustrated in FIG. 1. This places it in position to suspend backhoe bucket 16 within front loader bucket 14.

Hook portion 56 forms a hook 60 which is configured to receive backhoe bucket mounting pin 36. Each hook portion 56 also includes a U-shaped slot 62 (see FIG. 2) which extends toward proximal end 46 and is dimensioned to receive backhoe bucket mounting pin 36. U-shaped slots 62 help securely hold backhoe bucket 16 to engagement member 40 when backhoe bucket 16 is in loader bucket 14 as shown in FIG. 1.

The pivotable mounting of engagement member 40 to loader bucket mounting pin 32 is such that hooks 60 are movable between two positions with respect to loader bucket 14. These are a first hook position illustrated in FIGS. 1 and 6 and second hook position illustrated in FIGS. 3, 4 and 5.

Figure 5:
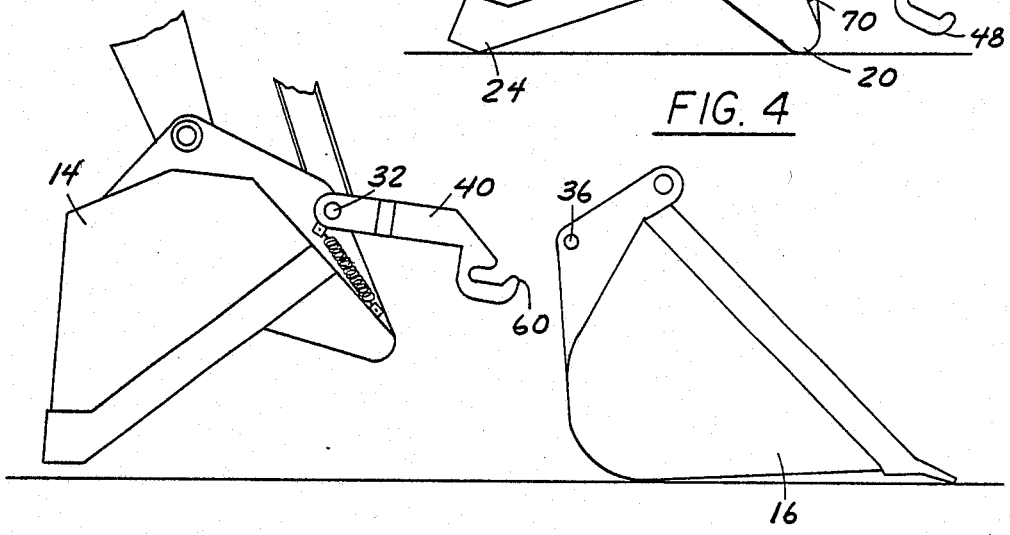
FIG. 5 is another similar view, but showing the loader bucket rolled to an orientation for engagement with the mounting pin of a backhoe bucket.
Figure 6:
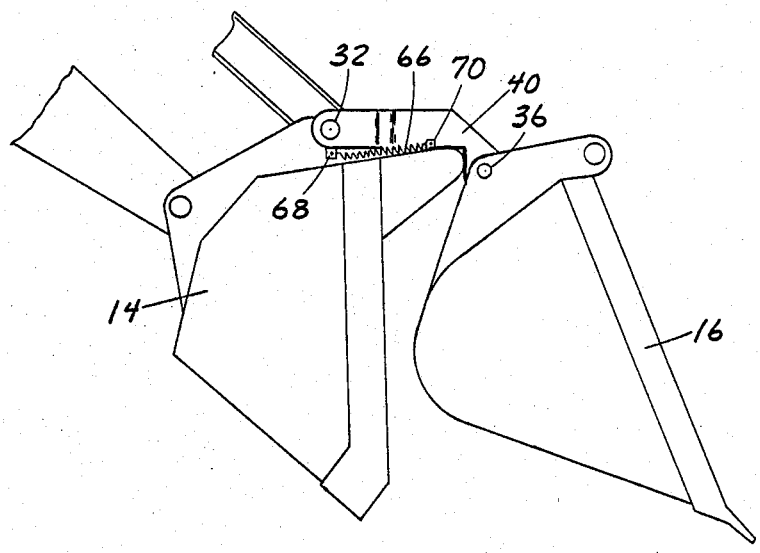
FIG. 6 is still another similar view, but showing the engagement member suspending the backhoe bucket with the loader bucket partially pivoted toward the full engagement position shown in FIG. 1.

In the first position, shown in FIGS. 1 and 6, hooks 60 are adjacent to loader bucket top edge 20 in position over the open mouth of loader bucket 14. In this position, they can support backhoe bucket 16 within loader bucket 14. In such first position, hooks 60 allow relative rotation of backhoe bucket 16 and loader bucket 14 as loader bucket 14 is rotated in the normal manner, under the control of a tractor operator. For the more forward orientations of loader bucket 14, such as those shown in FIG. 5 and FIG. 1, backhoe bucket 16 is suspended by hooks 60 until loader bucket 14 comes under and engages backhoe bucket 16.

Figure 3:
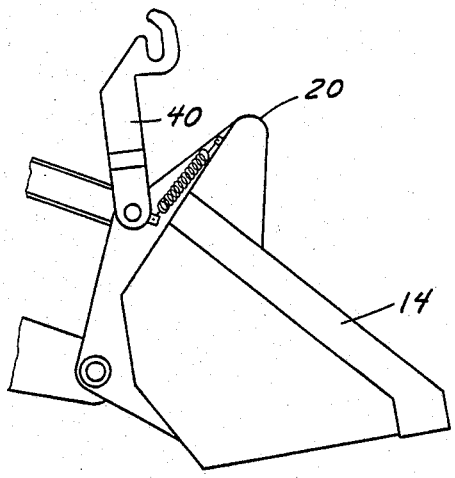
FIG. 3 is a side elevation of front loader bucket having the apparatus of this invention, with the loader bucket in a position for normal use.
Figure 4:
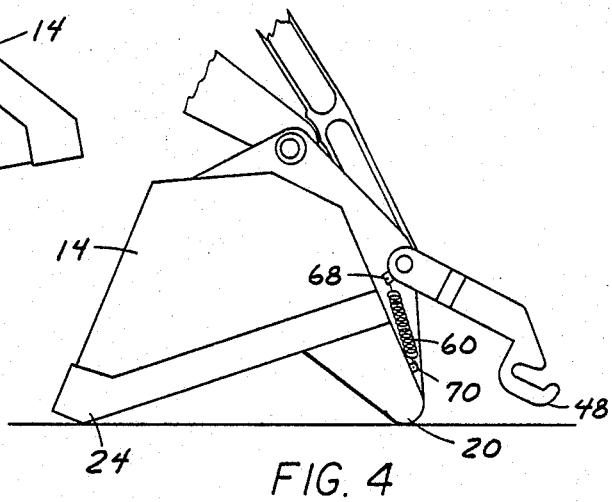
FIG. 4 is a similar side elevation, but showing the loader bucket in an open-side-down position.

The second position of hooks 60 with respect to loader bucket 14, illustrated in FIGS. 3–5, is outside top edge 20 where hooks 60 will not interfere with the normal operations of loader bucket 14. The non-interference of hook 60 in such second position is best illustrated in FIG. 4, in which top and bottom loader bucket edges 20 and 24 are on the ground. This position for a front loader bucket 14 is common, particularly when the loader bucket is used as a anchor for backhoe operations. In this position, it may easily be noted that hooks 60 at distal ends 48 of elongated members 42 are well above ground level, so that no interference is possible.

The positions of engagement member 40 and its hooks 60, when a backhoe bucket is not engaged by hooks 60, are dictated by springs 66. Springs 66 bias hooks 60 to the second position already described.

Figure 2:
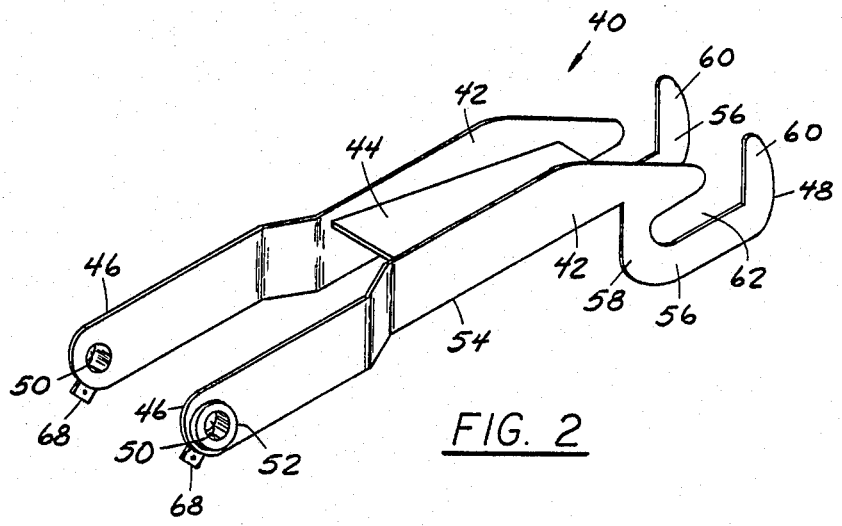
FIG. 2 is an enlarged perspective of the engagement member, a principal part of the apparatus of FIG. 1.

For each spring 66, a first spring-attachment member 68 is affixed, preferably by integral formation, to engagement member 40 near its proximal end 46. First spring-attachment members 68, as best illustrated in FIG. 2, are tabs extending generally transversely to elongated members 42. Tabs 68 have holes for attachment of springs 66. For each spring 66, a second spring-attachment member 70 is affixed to loader bucket top wall 18 at a position between loader bucket mounting pin 32 and loader bucket top edge 20. Second spring-attachment members 70 have holes allowing attachment of the other ends of springs 66.

When engagement member 40 is against loader bucket top wall 18, with hooks 60 at the first position, springs 66 extend in tension between their first and second spring-attachment members 68 and 70. The weight of backhoe bucket 16 resting on hooks 66 easily overcomes the spring force. However, when no backhoe bucket is held by engagement member 40, the spring force on tabs 68 causes engagement member 40 to rotate about loader bucket mounting pin 32 to the position shown in FIGS. 3–5, in which hooks 60 are in the second position. Such pivoting motion of engagement member 40 occurs because engagement member 40 functions like a first-degree lever, with its pivot mount between tabs 68 and hook portion 56.

FIGS. 5, 6 and 1 best illustrate the operation of the backhoe bucket transport apparatus of this invention. FIG. 5 shows loader bucket 14 and its attached engagement member 40 moving forward toward backhoe bucket 16 which is resting on the ground. Open hooks 60 engage backhoe bucket mounting pin 36 as loader bucket 14 moves forward and then rotates upwardly. FIG. 6 illustrates continued upward rotation after backhoe bucket 16 has been engaged by hooks 60. Note that backhoe bucket 16 is suspended and free to rotate about the connection of its mounting pin 36 with hooks 60. Continued rotation finally brings loader bucket 14 to a position in which backhoe bucket 16 is received into it, as illustrated in FIG. 1.

Engagement member 40 and all the other portions of the improved backhoe bucket transport system of this invention may be made using steel or other suitable materials. Appropriate materials and construction methods would be apparent to those skilled in the art who are familiar with this invention.

A number of variations are possible. For example, rather than having the engagement member pivot-mounted on the loader bucket mounting pin, a separate pivot mount could be attached at a nearby point on loader bucket 14. A wide variety of movable mountings could be used. A wide variety of other biasing means and configurations are possible in order that the engagement member and its hooks be automatically removed, as preferred, from positions of possible interference with loader bucket operations.

A pair of engagement members could be attached to the two ear sets on loader bucket 14, thus allowing the carrying of two extra backhoe buckets, rather than one.

While the principles of this invention have been described in connection with specific embodiments, it should be understood clearly that these descriptions are made only by way of example and are not intended to limit the scope of the invention.

What is claimed:

1. In a backhoe bucket transport system of the type including a tractor, a loader bucket attached to the tractor and having bottom and top walls and edges, and a backhoe bucket in the loader bucket, the backhoe bucket having a backhoe-mounting pin, the improvement comprising an engagement member secured to the loader bucket and having an open hook configured to receive the backhoe-mounting pin, the hook positioned adjacent to the top edge to support the backhoe bucket within the loader bucket such that pivoting of the loader bucket allows rotation of the backhoe bucket with respect thereto about the hook.

2. The backhoe bucket transport system of claim 1 wherein:

the engagement member is movably secured to the bucket such that the hook is movable between a first position which is inside the top edge and a second position which is outside the top edge; and the hook terminating above ground when in its second position with both top and bottom loader-bucket edges on the ground.

3. The backhoe bucket transport system of claim 2 further comprising means to bias the hook to the second position.

4. The backhoe bucket transport system of claim 2 wherein the engagement member comprises:

an elongated member with a proximal end, a distal end, and a top-wall spanning portion extending therebetween;

means near the proximal end for pivot mounting the engagement member with respect to the loader-bucket top wall; and a hook portion at the distal end extending transverse to the top-wall spanning portion such that when the top-wall spanning portion engages the top wall the hook portion extends across the loader-bucket top edge and the hook is in the first position.

5. The backhoe bucket transport system of claim 4 further comprising means to bias the hook to the second position.

6. The backhoe bucket transport system of claim 5 wherein the biasing means comprises a spring.

7. The backhoe bucket transport system of claim 6 wherein first and second spring-attachment members are affixed to the engagement member and bucket, respectively, the spring extending in tension between the spring-attachment members.

8. The backhoe bucket transport system of claim 4 wherein the hook portion includes a U-shaped slot extending toward the proximal end and dimensioned to receive the backhoe-mounting pin, whereby the backhoe bucket will be held securely by the engagement member in the loader bucket.

9. The backhoe bucket transport system of claim 2 wherein the engagement member is pivotably mounted to the top wall.

10. The backhoe bucket transport system of claim 9 wherein:

the loader bucket includes a mounting ear on its top wall with a loader-mounting pin therethrough for pivotably mounting of the loader bucket; and the engagement member is pivotable about the loader-mounting pin.

11. The backhoe bucket transport system of claim 10 wherein the engagement member comprises:

an elongated member with a proximal end, a distal end, and a top-wall spanning portion extending therebetween;

means near the proximal end for pivot mounting the engagement member to the loader-mounting pin; and a hook portion at the distal end extending transverse to the top-wall spanning portion such that when the top-wall spanning portion engages the top wall the hook portion extends across the loader-bucket top edge and the hook is in the first position.

12. The backhoe bucket transport system of claim 11 further comprising means to bias the hook to the second position.

13. The backhoe bucket transport system of claim 12 wherein the biasing means comprises a spring.

14. The backhoe bucket transport system of claim 13 wherein first and second spring-attachment members are affixed to the engagement member and bucket, respectively, the spring extending in tension between the spring-attachment members.

15. The backhoe bucket transport system of claim 13 wherein:

the second spring-attachment means is between the pivot-mounting means and the loader-bucket top edge; and the pivot-mounting means on the engagement member is between the first spring-attachment member and the hook portion, whereby the engagement member functions like a first-degree lever.

16. The backhoe bucket transport system of claim 15 wherein the hook portion includes a U-shaped slot extending toward the proximal end and dimensioned to receive the backhoe-mounting pin, whereby the backhoe bucket will be held securely by the engagement member in the loader bucket.

17. The backhoe bucket transport system of claim 16 wherein the engagement member comprises a pair of the elongated members affixed together in parallel spaced relationship.

* * * * *